US005524311A

United States Patent [19]

Crossley

[11] Patent Number: 5,524,311

[45] Date of Patent: Jun. 11, 1996

[54] HAND HELD GOLF BALL WASHER

[76] Inventor: Norman Crossley, Box 268, Solon, Iowa 52333

[21] Appl. No.: 503,949

[22] Filed: Jul. 19, 1995

[51] Int. Cl.[6] ..... A63B 47/04

[52] U.S. Cl. ..... 15/21.2; 15/21.1

[58] Field of Search ..... 15/21.2, 56, 57, 15/88.2, 207.2, 88.3, 88.1, 21.1, 38, 39, 97.1

[56] References Cited

U.S. PATENT DOCUMENTS

| | | | |
|---|---|---|---|
| 1,564,388 | 12/1925 | Westvig | 15/56 |
| 1,920,064 | 7/1933 | Cogsdill | 15/21.2 |
| 2,195,303 | 3/1940 | Haskins | 15/21.2 |
| 2,575,814 | 11/1951 | Jankowski | 15/21.2 |
| 3,355,756 | 12/1967 | Casbarro | 15/21.2 |
| 3,365,739 | 1/1968 | Olinghouse | 15/21.2 |
| 3,460,179 | 8/1969 | Falckenberg | 15/21.2 |
| 4,442,564 | 4/1984 | Berry | 15/21.2 |
| 5,400,455 | 3/1995 | Crossley | 15/21.2 |

FOREIGN PATENT DOCUMENTS

| | | | |
|---|---|---|---|
| 13877 | 6/1907 | United Kingdom | 15/21.2 |

*Primary Examiner*—David Scherbel
*Assistant Examiner*—Tony G. Soohoo
*Attorney, Agent, or Firm*—Allan L. Harms

[57] ABSTRACT

An improved, hand-held, battery powered golf ball washer having a case with a ball receiving chamber and a motor containing chamber, the ball receiving chamber having therein a U-shaped brush which is rotatable within the ball receiving chamber and in relatively close relationship to the wall of the ball receiving chamber. The ball receiving chamber is provided with a curved T-shaped stationary brush mounted to its inner wall such that a golf ball may be inserted within the ball-receiving chamber, a detergent solution added, a hatch closed over the opening, with motor means within the motor containing chamber to drive the U-shaped brush about the golf ball in the ball receiving chamber, thereby causing the ball to rotate and scrub against the stationary brush while the rotatable brush scours the ball as well.

20 Claims, 3 Drawing Sheets

HAND HELD GOLF BALL WASHER

CROSS REFERENCE

This application is co-pending with Ser. No. 08/140,745 of the same applicant titled Hand Held Golf Ball Washer, filed Oct. 22, 1993, now U.S. Pat. No. 5,400,455.

BACKGROUND OF THE INVENTION

This invention pertains to golf ball washing devices and in particular to hand held golf ball washers.

In the course of the playing of the game of golf, it is inevitable that the golf ball becomes grass-stained and caked with mud. In order to make the driven ball easier to find and to ensure that its flight characteristics are not affected by the presence of mud or other foreign material upon the surface of the ball, it is useful to clean the surface of the golf ball to remove foreign material and Grass or other stains.

Available golf ball washers which are known are predominantly nonportable and nonmotorized, such as illustrated in Burkholder, U.S. Pat. No. 3,678,526; Procario, U.S. Pat. No. 2,744,274; and Brillhart, U.S. Pat. No. 2,031,633. A manually driven, portable golf ball washer is disclosed in McConnell, U.S. Pat. No. 3,508,016.

A motorized portable golf ball washer is shown in U.S. Pat. No. 4,381,574 to Benkovsky which features a foam lined cup which rotates about the ball while held in place by a liner/retainer which resists turning of the ball. In order to wash the entire ball, it would be necessary to move the ball during the washing operation to another orientation in the cup so that the portion of the ball's surface which had been retained by the liner would then be washed.

Ingram et al., U.S. Pat. No. 4,084,287, teaches a hand operated portable ball cleaner which provides a toroidal sponge inside stiff rings which operates upon the golf ball's surface as the ball is manipulated by the user.

Stoltzman, U.S. Pat. No. 4,210,974, discloses an elongated ball washer for portable use featuring a bristle-lined slot to receive the golf ball which is reciprocated in the slot.

British patent number 13,877 shows a washer powered by an egg beater mechanism which rotates the ball in contact with concave brush surfaces.

None of the above described washers provides a battery-powered, portable, hand-held golf ball washer which washes the entire ball surface in one operation and yet is simple to operate and maintain.

Applicant's pending application Ser. No. 08/140,745 entitled Hand Held Golf Ball Washer discloses a ball washer which employs a case with a ball receiving chamber and a motor containing chamber, the ball receiving chamber having therein a ring shaped brush free to rotate within the ball receiving chamber and in relatively close relationship to the wall of the ball receiving chamber with the ball receiving chamber having a removable hatch therein positioned such that a golf ball may be inserted within the ring-shaped brush in the ball-receiving chamber, a detergent solution added, and the hatch closed, with motor and gear means within the motor containing chamber to drive the ring-shaped brush about the golf ball in the ball receiving chamber.

SUMMARY OF THE INVENTION

The present invention provides an improved, hand-held, battery powered golf ball washer having a case with a ball receiving chamber and a motor containing chamber, the ball receiving chamber having therein a U-shaped brush which is rotatable within the ball receiving chamber and in relatively close relationship to the wall of the ball receiving chamber. The ball receiving chamber is provided with a curved T-shaped stationary brush mounted to its inner wall such that a golf ball may be inserted within the ball-receiving chamber, a detergent solution added, a hatch closed over the opening, with motor means within the motor containing chamber to drive the U-shaped brush about the golf ball in the ball receiving chamber, thereby causing the ball to rotate and scrub against the stationary brush while the rotatable brush scours the ball as well.

It is an object of this invention to provide an effective golf ball cleaner which can be carried with the golfer and employed as needed as the player proceeds along the golf course.

It is a further object of the Invention to provide a motorized golf ball washer which is portable and capable of washing the entire surface of the golf ball in a single operation.

It is a further object of the Invention to provide a golf ball washer which can be powered by dry cell batteries.

These and other objects of the Invention will be illustrated in the detailed description which follows.

DESCRIPTION OF THE DRAWING FIGURES

DETAILED DESCRIPTION OF THE INVENTION

Figure 1:
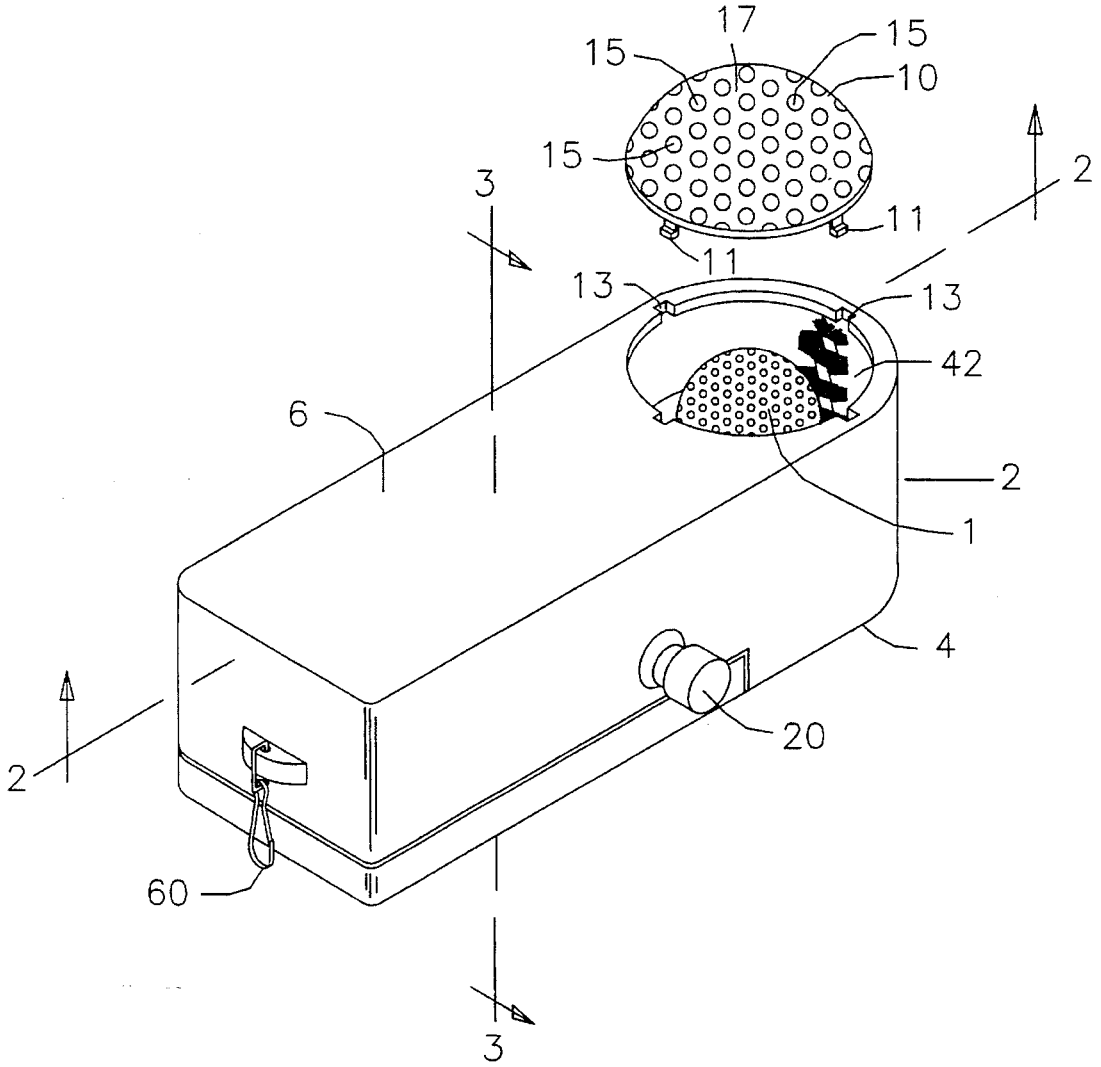
FIG. 1 is a perspective view of the preferred embodiment of the golf ball washer with its hatch member displaced and showing a golf ball in place therein.

The preferred embodiment of the present invention 2 is shown in perspective in FIG. 1. An elongate case 4 is provided with a front wall 6 having an opening 42 from which removable cover 10 is retractable. Cover 10 is removably mounted to front wall 6 by bayonet means provided therefor, comprising legs 11 which may be inserted in notches 13 of opening 42 such that when cover is rotated, legs 11 will retain cover 10 to case 4. Other attachment means may be employed to retain cover 10 to opening 42 in front wall 6. A push button normally open switch 20 is mounted upon case 4 at a convenient location thereon. It is to be understood that case 4 may be of cylindrical, hemispherical, rectangular, or other desirable shape.

Figure 2:
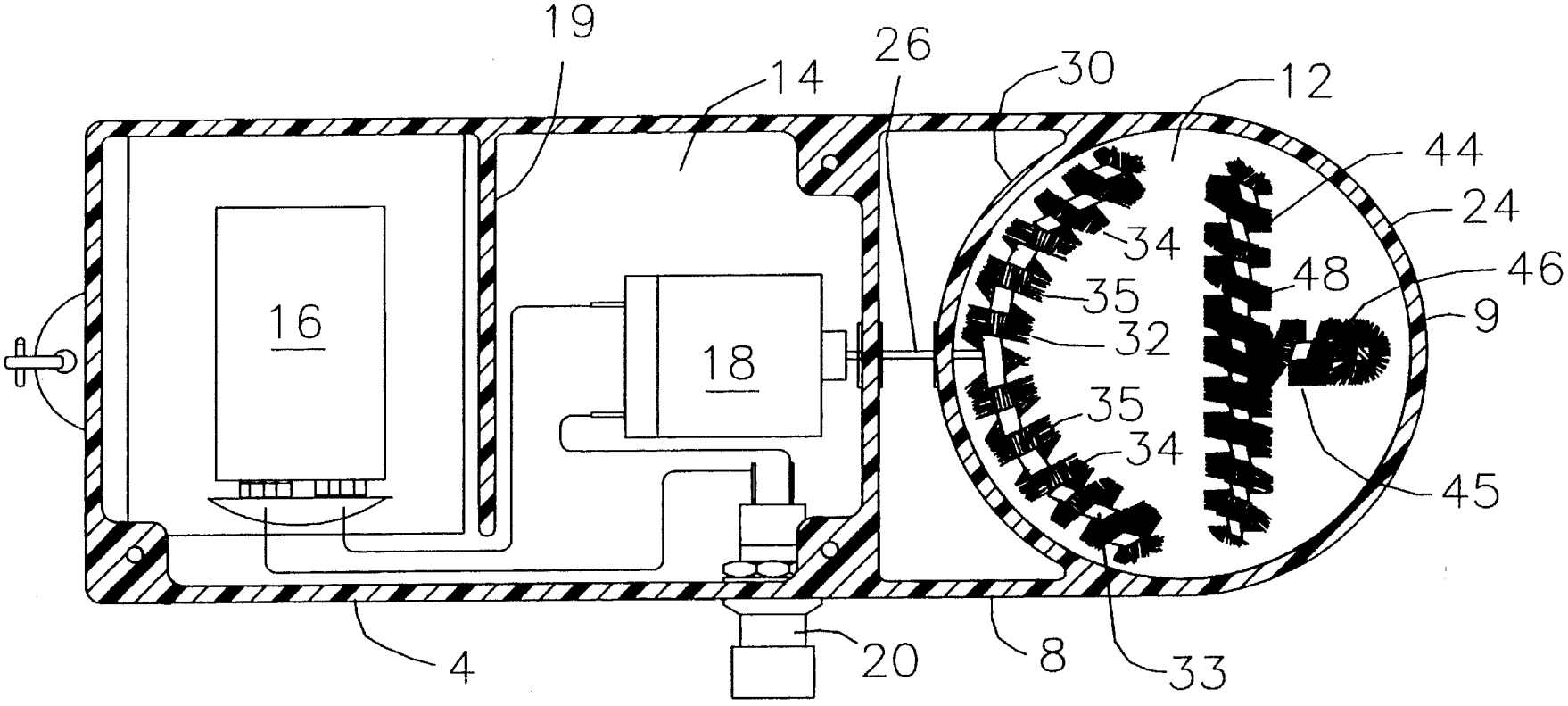
FIG. 2 is a cross section along line A—A of FIG. 1 with the golf ball removed.
Figure 3:
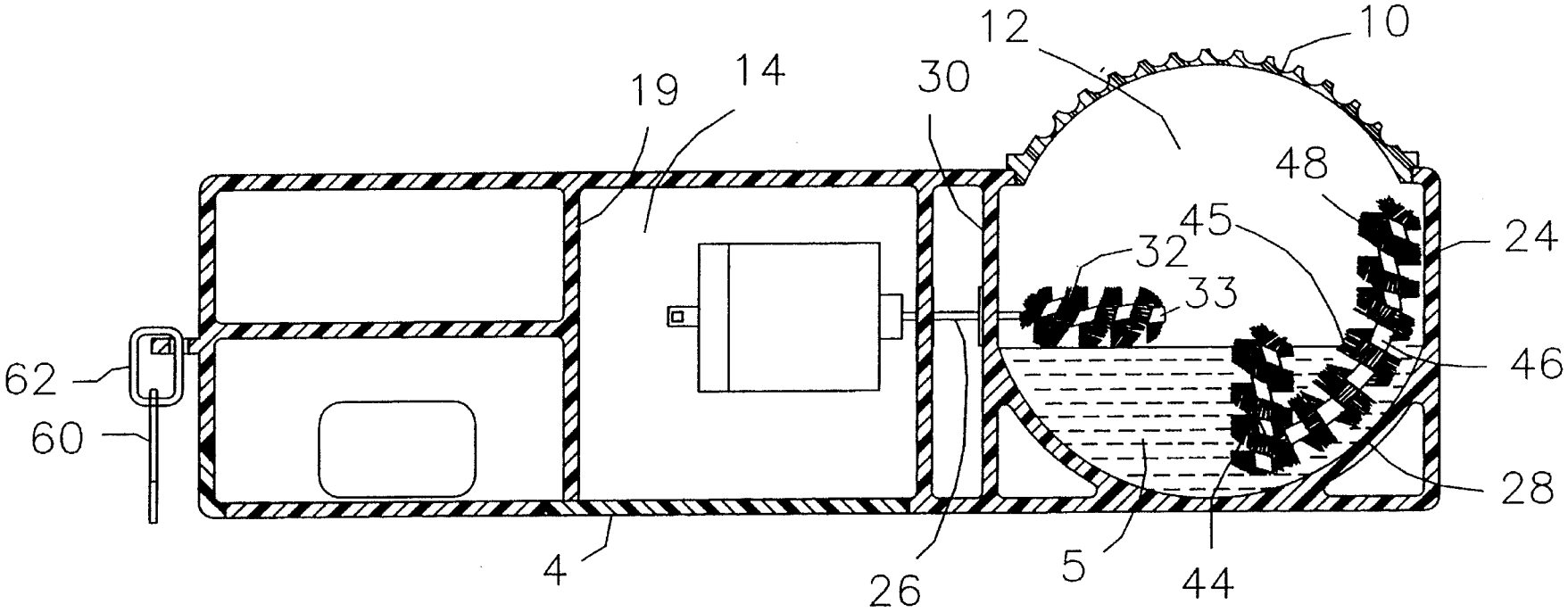
FIG. 3 is a cross section along line B—B of FIG. 1 with the golf ball removed.

Referring to FIGS. 2 and 3, it can be visualized that case 4 is provided with a first chamber 12 and a second chamber 14 therein, the first chamber 12 being a ball receiving chamber which is located within first end 8 of case 4. In the preferred embodiment, first chamber 12 is partially cylindrical in shape. Opening 42 of front wall 6 of case 4 is generally circular, embodying a first end of a cylindrical chamber wall segment 24 which is enclosed at its lower end by dome section 28. Because cover 10 is generally dome shaped, when cover 10 is placed over opening 42, chamber 12 comprises a cylindrical enclosure with domed ends.

Rib 19 is provided within chamber 14 as needed to provide structural stability to case 4. Second chamber 14 is provided to receive a dry cell power supply 16 electrically connected to direct current motor 18 through switch 20 such that power supply 16 powers motor 18 when switch 20 is depressed. In the preferred embodiment, power supply 16 comprises a 9 VDC dry cell. Driven shaft 26 of motor 18 is rotated at a speed in the range of 50 to 300 revolutions per minute (RPM), preferably approximately 125 RPM. In the preferred embodiment, motor 18 is a d-c motor which operates on 6.0–12.0 VDC power at 4100–8300 RPM under load.

First chamber 12 and second chamber 14 are separated by curved watertight wall 30 through which passes driven shaft 26. Driven shaft 26 is mounted to rotor brush member 32 such that rotor brush member 32 will rotate on an axis generally coincident with the axis of case 4. Rotor brush member 32 comprises a curved, U-shaped segment having a spine 33 which is provided with bristles 34 which inwardly depend from spine 33 to engage the surface of a golf ball 1 placed within first chamber 12, such that inwardly depending ends 35 of bristles 34 will contact golf ball 1. It can be understood that the depending ends 35 of bristles 34 generally define a segment of a circle with a radius generally equal to the radius of a golf ball.

Static brush member 45 is fixed to inside surface 7 of distal wall 9 of chamber 12. Static brush member 45 approximates a T-shape and comprises first and second segments 44 and 46 respectively which are curved to conform to the shape of inside surface 7 of chamber 12 and are fixed thereto, wherein second segment 46 joins first segment 44 generally at its midpoint in orthogonal fashion at the point of joinder. First segment 44 is fixed to dome section 28 spaced apart from the equatorial line thereof a small amount in the preferred embodiment. First segment 44 defines a plane which is generally perpendicular to the axis of driven shaft 26. Second segment 46 is fixed to inside surface 7 such that it is fixed to dome section 28 and extends along cylindrical wall segment 24 and opposes rotor brush member 32. The plane defined by second segment 46 is generally parallel to the axis of driven shaft 26. Static brush member 45 is provided with inwardly depending bristles 48 which will engage a golf ball 1 when it is placed in chamber 12 with cover 10 disposed over opening 42. Static brush member 45 defines a spherical segment with a radius approximately equal to the radius of a golf ball.

In the preferred embodiment, rotor brush member 32 and static brush member 45 are constructed by winding bristles about a metal twisted spine thereby fashioning spiral flighting of bristles upon the curved spine. Bristles 34 and 48 of brush members 32 and 45 respectively are trimmed to a length of approximately ⅛".

Detergent solution 5 is introduced into first chamber 12 in sufficient quantity to assist cleaning of golf ball 1 by rotor brush member 32 and static brush member 45.

Clip 60 is provided by pivotable attachment means 62 upon case 4 to provide means for attachment of invention 2 to the user's golf bag, golf cart, or clothing.

In order to provide a pleasing appearance for invention 2, cover 10 is preferably molded of white polymer material with dimples 15 formed in the outside face 17 thereof, such that cover 10 resembles an oversize golf ball section.

OPERATION OF THE INVENTION

It can be readily seen that cover 10 may be removed from case 4 and a golf ball 1 inserted through opening 42 therein. A small amount of detergent solution 5 may be placed into first chamber 12 and cover 10 replaced into opening 42 to close first chamber 12. Push button switch 20 may be depressed by the user which causes motor 18 to be energized thereby driving shaft 26 to cause rotation of rotor brush member 32 against ball 1 which also is scrubbed against static brush member 45 as rotor brush member 32 turns. After sufficient operation of motor 18, the push button 20 is released and cover 10 is removed such that golf ball 1, now clean, may be removed and used in the golf game.

Having described the invention, I claim:

1. A hand held golf ball washing apparatus comprising an elongate case having a first chamber and a second chamber separated by a watertight wall, the elongate case having an opening therein communicative with the first chamber, a cover receivable over said opening, a motor and power supply mounted within said second chamber, electrical switch means mounted on said case to selectively energize the motor, a U-shaped brush member positioned in said first chamber, said U-shaped brush member rotatable about a central symmetrical axis thereof, driven shaft means interconnecting the U-shaped brush member and the motor, said U-shaped brush defining a segment of a circle.

2. The golf ball washing apparatus of claim 1 wherein a stationary brush member is mounted within said first chamber, said stationary brush member disposed to oppose said U-shaped brush member.

3. The golf ball washing apparatus of claim 2 wherein said switch means is a normally open switch, said switch activated by manual means external to said case.

4. The golf ball washing apparatus of claim 2 wherein said switch means is a normally open push button switch mounted within the wall of said case.

5. The golf ball washing apparatus of claim 2 wherein said U-shaped brush member is driven at a rotational velocity in the range of 50–200 RPM.

6. The golf ball washing apparatus of claim 2 wherein said power supply is a 9 volt dry cell battery.

7. The golf ball washing apparatus of claim 2 wherein said first chamber has a cylindrical sidewall with a dome shaped cover fixed thereon.

8. The golf ball washing apparatus of claim 2 wherein said cover is dome shaped.

9. A portable golf ball washing apparatus comprising a case having a first chamber and a second chamber therein separated by a generally watertight wall, the first chamber having an opening therein and a removable cover for said opening, said first chamber including an inside wall, said first chamber having a rotor brush member and a stationary brush member therein, the second chamber having a dry cell battery and a motor disposed therein, said battery and said motor electrically coupled through a normally open switch, said rotor brush mechanically coupled to said motor by a driven shaft passing through the generally watertight wall of said case, said rotor brush defining a curved segment of a circle, said curved segment generally conforming to the shape of a golf ball, said stationary brush fixed to the inside wall of said first chamber, said rotor brush rotatable on a central symmetrical axis thereof.

10. The apparatus of claim 9 wherein said stationary brush is mounted to said inside wall in opposition to said rotor brush.

11. The apparatus of claim 10 wherein said curved segment joined at its midpoint to said driven shaft.

12. The apparatus of claim 9 wherein said rotor brush comprises a curved spine with bristles depending generally perpendicularly therefrom, said bristles having ends thereof defining a curve conforming to the shape of a golf ball.

13. The apparatus of claim 11 wherein said first chamber having a cylindrical sidewall with a dome shaped cover fixed thereon, said stationary brush comprising a first curved element and a second curved element, said stationary brush member defining a cavity, said cavity generally opposing said curved segment of said rotor brush, said cavity generally conforming to the shape of a golf ball.

14. The apparatus of claim 13 wherein said second curved element of said stationary brush at first end and a free end, the first end of said second curved element joined to the midpoint of said first curved element.

15. The apparatus of claim 14 wherein said first curved element fixed to the domed end of said first chamber, said second curved element fixed along the free end thereof to said cylindrical sidewall.

16. The apparatus of claim 15 wherein said rotor brush comprises a curved spine with bristles depending generally perpendicularly therefrom, said bristles having ends thereof defining a curve conforming to the shape of a golf ball.

17. The apparatus of claim 16 wherein said first curved element defines a plane generally perpendicular to the axis of said driven shaft, said second curved element is jointed generally perpendicularly to said first element.

18. The apparatus of claim 17 wherein said cover is dome shaped.

19. The apparatus of claim 18 wherein said cover comprising polymeric material formed with dimples thereon.

20. The apparatus of claim 19 wherein said cover is retained to said case by legs downwardly depending from said cover.

* * * * *